US006317054B1

(12) United States Patent
Grönstedt et al.

(10) Patent No.: US 6,317,054 B1
(45) Date of Patent: Nov. 13, 2001

(54) FIRE ALARM

(76) Inventors: Rickard Grönstedt, Artillerigatan 85, Stockholm 115 30 (SE); Michael Olsson, Tulegatan 20, Stockholm 113 53 (SE)

( * ) Notice: Subject to any disclaimer, the term of this patent is extended or adjusted under 35 U.S.C. 154(b) by 0 days.

(21) Appl. No.: 09/530,960

(22) PCT Filed: Nov. 26, 1998

(86) PCT No.: PCT/SE98/02139

§ 371 Date: May 17, 2000

§ 102(e) Date: May 17, 2000

(87) PCT Pub. No.: WO99/33036

PCT Pub. Date: Jul. 1, 1999

(30) Foreign Application Priority Data

Dec. 11, 1997 (SE) ..... 9704621

(51) Int. Cl.[7] ..... G08B 23/00

(52) U.S. Cl. ..... 340/693.6; 340/693.5; 340/693.9

(58) Field of Search ..... 340/628, 629, 340/630, 693.5, 693.6, 693.7, 693.9, 693.11

(56) References Cited

U.S. PATENT DOCUMENTS 4,004,228 * 1/1977 Mullett ..... 325/113
4,032,707 * 6/1977 Trenary ..... 340/628
4,694,281 * 9/1987 MxDermott et al. ..... 340/691.1

FOREIGN PATENT DOCUMENTS

2290900 * 1/1996 (GB) ..... G08B/17/10

* cited by examiner

*Primary Examiner*—Van T. Trieu
(74) *Attorney, Agent, or Firm*—Jacobson Holman, PLLC

(57) ABSTRACT

A fire warning device includes detachably connectable shell parts (1,2) which when brought together are mutually united to form a shell or casing (3) which houses a fire sensor (20), alarm emitter (21) and a power source (22). The shell (3) being provided with fire warning device suspension means (8, 9; 16, 17). The suspension means (8, 9; 16, 17) is comprised of a friction anchoring device disposed in the region of the border surface or interface (6) between the two shell parts (1,2) when the shell is closed. The friction anchoring device is disposed in a passageway that extends between two mutually opposite ends (4,5) of the closed shell and enables the shell to be closed around a rod, cable or chain that carries a light fitting, while connecting the cable, rod or chain to the friction anchoring device for suspending the fire warning device.

11 Claims, 1 Drawing Sheet

FIRE ALARM

BACKGROUND OF THE INVENTION

The present invention relates to a fire warning device.

The invention thus relates to a fire warning device of the kind which includes two shell parts, or shell parts, that can be detachably united to form a shell or shell that houses the sensor, alarm emitter and power source of the warning device, said shell being provided with means which enable the device to be suspended in the room of a building.

Such fire warning device are normally fitted high up in the room of a building, for instance high up on a wall or to the ceiling of said room.

Many house owners or apartment dwellers find the work of fitting such fire warning device in the prescribed and preferred position difficult to carry out. One further, troublesome drawback is that the walls and ceilings of dwelling places are often comprised of hard material (such as concrete) or of a fragile, weak material. Drawbacks of this nature have often caused the occupants of houses, apartments and other dwelling places to refrain from acquiring and fitting a fire warning device, against their better judgment.

SUMMARY OF THE INVENTION

The object of the present invention is to provide a fire warning device that includes a means of suspension that greatly facilitates and simplifies fitting of the fire warning device in a correct or acceptable position in a dwelling place. Another object of the invention is to provide a fire warning device that includes a suspension means that does not require the use of fasteners and obviates the need of drilling/plugging surfaces on which the device is to be fastened and of driving fasteners (screwing or nailing) into such surfaces and which does not require the use of adhesive device for suspending the fire warning device.

The object of the invention is thus to provide a fire warning device that includes suspension means that will not damage the ceilings, interior wall surfaces on which the fire warning device is hung, not even when moving the fire warning device to a different location.

These objects are achieved in accordance with the invention, by means of the fire warning device that includes detachably connectable shell parts which when united form a shell. The shell houses a fire sensor, an alarm emitter and a power source. The shell is also provided with suspension means. The suspension means comprises a friction anchoring device disposed in the region of a boundary surface or interface between the two shell parts when the two shell parts are united. Additionally, the friction anchoring device is disposed in a passageway that extends between two mutually opposite ends of the closed shell, such as to enable the shell to be closed around a rod, cable or chain that carries a light fitting whilst connecting the cable, rod or chain to the friction anchoring device for suspending the fire warning device.

The fire warning device is a split shell structure that includes two parts which can be detachably united and which when joined together form an enclosure which houses the sensor, alarm emitter and power source of the fire warning device. The means for suspending the fire warning device includes friction anchoring means disposed in the boundary surface or interface between the two connectable shell parts, said friction anchoring means being adapted to frictionally clamp the shell halves together while clamping a chain, rod or cable that carries a lighting fixture, such as to support the fire warning device on said cable, rod or chain.

In one embodiment, the friction anchoring device may consist of a plastic foam band or strap into which the cable, rod or chain is embedded when bringing the shell parts together.

The inventive fire warning device can be fitted high up beneath a ceiling quickly and easily, on a cable, chain or rod by means of which a light fitting is suspended from the ceiling.

In certain embodiments, the fire warning device may comprise two mutually identical shell halves which when joined together to form a rotational-symmetrical body about an axis along which the cable, rod, chain, extends.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

The invention will now be described in more detail with reference to exemplifying embodiments thereof and also with reference to the accompanying drawing.

DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
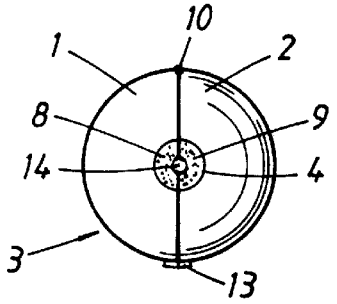
FIG. 1 is an end view of an inventive fire warning device.
Figure 2:
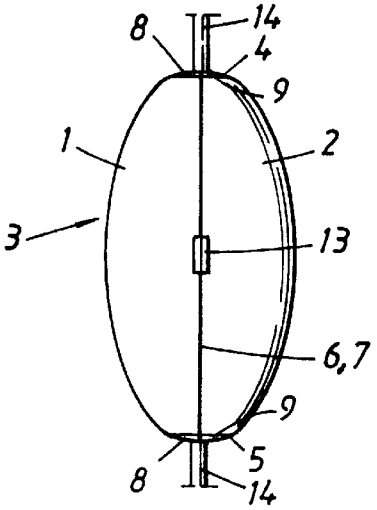
FIG. 2 is a side view of the fire warning device.
Figure 3:
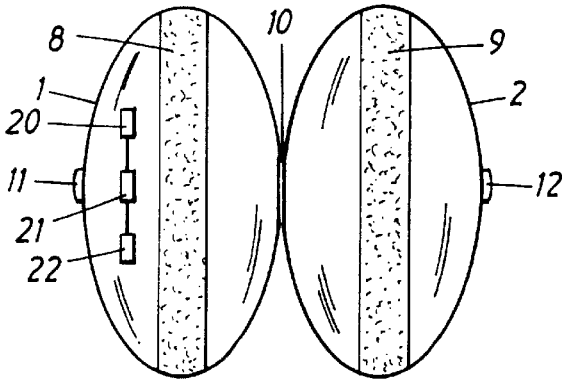
FIG. 3 is a side view showing an open fire warning device

As shown in FIGS. 1–3, the inventive fire warning device includes an essentially closed shell or casing 3 that has openings 4, 5 at two opposite ends thereof. The shell 3 is comprised of two mutually identical shell halves 1, 2 which meet in a partition plane 6 that includes an axis 7 about which the shell 3 is essentially rotational-symmetrical. The shell 3 (the shell halves 1, 2) house the sensor, alarm emitter and power source (battery) of the fire warning device. Each shell half 1, 2 includes a foamed plastic strip 8, 9 that has a delimiting surface in the opening plane of its respective shell half 1, 2, said opening plane coinciding with the parting line 6. The illustrated shell halves 1, 2 are hinged together by hinge means 10 that enables the shell halves 1, 2 to swing from the closed state shown in FIG. 1 to the open state shown in FIG. 3. Each of the shell halves 1, 2 also includes a respective part 11, 12 of an openable catch means 13, for instance a snap-catch. The shell halves 1, 2 are brought together while clamping a cable 14 located between the springy, elastic layers 8, 9 of foamed plastic, such as to anchor the fire warning device to the cable 14 by means of friction.

Figure 5:
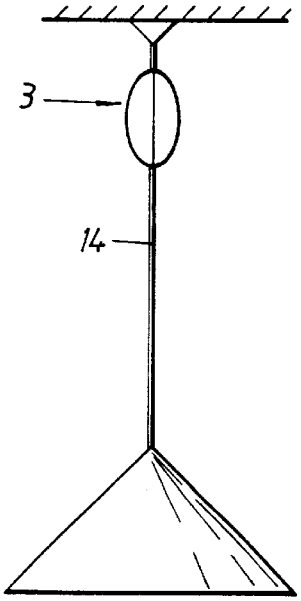
FIG. 5 illustrates an inventive fire warning device fitted to the suspension cable of a ceiling suspended light fitting.

FIG. 5 shows that the fire warning device can be easily mounted in the proximity of a ceiling, on a cable 14 whose upper end hangs from said ceiling and there connected to an electric socket and which carries a lamp at its other end.

Those surfaces of the foamed rubber strips or layers 8 and 9 which co-act with the cable 14 may be located slightly above the opening plane of respective shell halves, so as to obtain greater abutment pressure with the cable. It will be understood that one of the foamed strips 8, 9 may be omitted and replaced with a supporting surface instead.

Figure 4:
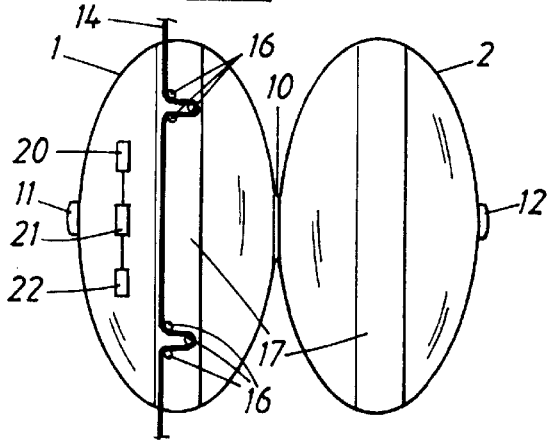
FIG. 4 illustrates another embodiment of the fire warning device in a view corresponding to the view of FIG. 3.

As an alternative to a foamed rubber strip, it is conceivable to use pegs which extend perpendicularly to said axis 7 in the path between the shell openings 4, 5, such as to form cable deflecting pegs as illustrated in FIG. 4. The pegs 16 can extend perpendicularly from a supporting plate 17 located slightly inwards of the parting line 6 in respective shell halves. One advantage afforded by the embodiment shown in FIG. 4 is that it enables the fire warning device to be shape-bonded to a chain, by passing at least one of the pegs 16 through a chain link corresponding to the cable 14.

The plates 17 may, of course, be covered with a springy elastic material that provides the same function as the foamed plastic strips 8, 9 in the embodiment according to FIG. 3. The strips 8, 9 will preferably comprise a springy, elastic foamed rubber material or foamed plastic material, although the use of generally solid elastomeric materials is also conceivable.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A fire warning device that includes detachably connectable shell parts which when united form a shell which houses a fire sensor, an alarm emitter and a power source, and which is provided with suspension means, said suspension means comprises a friction anchoring device disposed in the region of a boundary surface or interface between said two shell parts when the two shell parts are united; and in that the friction anchoring device is disposed in a passageway that extends between two mutually opposite ends of the closed shell, such as to enable said shell to be closed around a rod, cable or chain that carries a light fitting whilst connecting the cable, rod or chain to the friction anchoring device for suspending the fire warning device.

2. The fire warning device according to claim 1, wherein the friction anchoring device comprises an element made from an elastically deformable and springy material and connected with one of said shell halves and adapted to be compressively deformed by the cable, rod or chain when uniting said shell parts.

3. The fire warning device according to claim 1, wherein the friction anchoring device includes pegs that extend transversely to the direction of said passageway, such as to form a meandering pathway for a cable on which the fire warning device is hung.

4. The fire warning device according to claim 1, wherein the friction anchoring device includes an elastomeric element on each of said shell parts, said elastomeric elements being positioned so as to be compressed against each other when the shell parts are brought together to form said shell, while clamping a cable, rod or chain therebetween.

5. The fire warning shell according to claim 1, wherein said friction anchoring device further comprising:

elastically deformable and springy material connected to one of said shell parts and being compressively deformable.

6. The fire warning shell according to claim 1, wherein said friction anchoring device further comprising:

at least one peg extending transversely to the direction of said passageway and forming a meandering pathway for hanging said fire warning shell.

7. The fire warning shell according to claim 1, wherein said friction anchoring device comprising:

at least one elastomeric elements being positioned on each of said shell parts and being compressed against each other when the shell parts are together forming said shell.

8. The fire warning shell according to claim 1, wherein said friction anchoring device comprising:

a plastic foam band.

9. The fire warning shell according to claim 1, wherein said friction anchoring device comprising:

a plastic foam strap.

10. A fire warning device for suspending from an object such as a cable, rod or chain, said device comprising:

detachably and connectable shell parts having a passageway extending between two mutually opposite ends of said shell when said shell parts are connected;

a fire sensor housed in said shell for sensing fire;

an alarm emitter housed in said shell for emitting an alarm;

a power source housed in said shell for providing power; and a friction anchoring device positioned between the passageway for closing around said object and anchoring the fire warning shell therefrom.

11. A fire warning shell having a fire sensor, alarm emitter and a power source for suspending from an object such as a cable, rod or chain, said shell comprising:

detachably and connectable shell parts; and a friction anchoring device disposed on each of said two shell parts and extending between two mutually opposite ends of the shell for closing around said object and anchoring the fire warning shell therefrom.

* * * * *